US007772139B2

(12) United States Patent
Chandra

(10) Patent No.: US 7,772,139 B2
(45) Date of Patent: Aug. 10, 2010

(54) PERMEABLE NON-WOVEN FABRIC BASED PACKAGING

(76) Inventor: Shubham Chandra, 20 Zain Cir., Milford, MA (US) 01757

( * ) Notice: Subject to any disclaimer, the term of this patent is extended or adjusted under 35 U.S.C. 154(b) by 125 days.

(21) Appl. No.: 12/051,844

(22) Filed: Mar. 19, 2008

(65) Prior Publication Data

US 2009/0239432 A1 Sep. 24, 2009

(51) Int. Cl.
*B32B 27/20* (2006.01)
*B32B 5/16* (2006.01)

(52) U.S. Cl. ..... 442/72; 96/11

(58) Field of Classification Search ..... 442/72; 96/11

See application file for complete search history.

(56) References Cited

U.S. PATENT DOCUMENTS

| | | | | |
|---|---|---|---|---|
| 2,611,709 | A | 9/1952 | Plagge | |
| 3,450,543 | A | 6/1969 | Badran et al. | |
| 3,507,667 | A * | 4/1970 | Magnen | 426/419 |
| 3,798,333 | A | 3/1974 | Cummin et al | |
| 3,804,961 | A | 4/1974 | Cummin et al. | |
| 4,224,347 | A | 9/1980 | Woodruff | |
| 4,769,262 | A | 9/1988 | Ferrar et al. | |
| 4,810,764 | A | 3/1989 | Friends et al. | |
| 5,008,296 | A | 4/1991 | Antoon, Jr. et al. | |
| 6,190,710 | B1 | 2/2001 | Nir et al. | |
| 6,376,032 | B1 | 4/2002 | Clarke et al. | |
| 6,548,132 | B1 | 4/2003 | Clarke et al. | |
| 6,953,617 | B2 | 10/2005 | DeMeuse | |
| 2008/0034964 | A1 * | 2/2008 | Schmidt et al. | 95/12 |

FOREIGN PATENT DOCUMENTS

| | | | |
|---|---|---|---|
| JP | 04030727 A | * | 2/1992 |
| JP | 062126875 | * | 5/1994 |

OTHER PUBLICATIONS

Xuetong Fan, Brendan A. Niemira, Christopher J. Doona , Florence E. Feeherry, Robert B. Gravani, Enhanced Safety and Extended Shelf-life of Fresh Produce for the Military, Microbial Safety of Fresh Produce, ISBN: 978-0/8138-0416-3, Chapter 14, IFT Press, USA.

(Continued)

*Primary Examiner*—Norca L Torres-Velazquez
(74) *Attorney, Agent, or Firm*—Chapin IP Law, LLC

(57) ABSTRACT

Packaging using Gas Permeable Non-Woven Fabric based Film extends the shelf life of various fresh fruits and vegetables and vase life of fresh cut flowers by changing the atmosphere in which these living products are stored and respires. The high oxygen and carbon dioxide permeability of the Gas Permeable Non-Woven Fabric based Film establishes an ideal atmosphere for the specific perishable item, and therefore extends its shelf life. The establishment of lower oxygen and carbon dioxide atmospheres inside packages using Gas Permeable Non-Woven Fabric based film, also leads to reduction in the respiration rate of the perishable items. The reduction in the respiration rate prevents loss of moisture, production of metabolic heat, and yellowing, browning, reduction in production levels of ethylene. Thus the created atmosphere is able to extend shelf life, maintain high quality and preserve nutrients of fresh produce items by naturally regulating respiration of said produce/flower.

19 Claims, 3 Drawing Sheets

OTHER PUBLICATIONS

P.C.Talasila, K.V.Chau, J.K.Brecht, Design of Rigid Modified Atmosphere Packages for Fresh Fruits and Vegetables, 758-Journal of Food Science-vol. 60, No. 4, 1995.

Adel A. Kader, Christopher B. Watkins, Modified Atmosphere Packaging—Toward 2000 and Beyond, Horticulture, Jul.-Sep. 2000.

Jatal D. Mannapperuma, Devon Zagory, R. Paul Singh and Adel Kader, Design of Polymeric Packages for Modified Atmosphere Storage of Fresh Produce, Proceedings of the Fifth International Controlled Atmosphere Research Conference, vol. 2, Jun. 14-16, 1989.

Kuo, Alex, Silicone Release Coatings for the Pressure Sensitive Industry—Over View & Trends, Dow Corning Corporation.

Kerbel, Eduardo, Banana and Plantain, Dole Fresh Fruit International Ltd.

Zagory, Devon, An Update on Modified Atmosphere Packaging of Fresh Produce, Packaging International 117, Apr. 1998.

Zagory, Devon, Kader, A, Use of a Computer Model in the design of Modified Atmosphere Packages for Fresh Fruits and Vegetables, Proceedings of the fifth International Controlled Atmosphere Research Conference, Jun. 14-16, 1989.

Kader, Adel, Zagory, Devon, Eduardo, Kerbel, Modified Atmosphere Packaging of Fruits and Vegetables, Critical Reviews in Food Science and Nutrition, vol. 28 Issue 1, 1989.

Uchino, Toshitaka, Development of a mathematical model for dependence of respiration rate of fresh produce on temperature and time, Post Harvest Biology and Technology 34, 2004, pp. 285-293.

Fishman, Svetlana, Model for Gas Dynamics in Modified Atmosphere Packages of Fruits and Vegetables, Journal of Food Science, vol. 60, No. 5, 1995.

Exama, A, Suitability of Plastic Films for Modified Atmosphere Packaging of Fruits and Vegetables, Journal of Food Science, vol. 58, No. 6, 1993, pp. 1365-1370.

Saltveit, M.E., Respiratory Metabolism, Mann Laboratory, Department of Vegetable Crops, University of California, Davis, CA.

* cited by examiner

PERMEABLE NON-WOVEN FABRIC BASED PACKAGING

FIELD OF THE INVENTION

The invention relates to a Gas Permeable Non-Woven Fabric based Film with high permeability towards oxygen and carbon dioxide, and is directed more particularly to such a packaging system as is suitable for extending the shelf life of fresh fruits and vegetables (both whole and fresh cut), and vase life of flowers.

BACKGROUND

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor.

The packaging systems provided in the art range from basic low density polyethylene bags to fairly sophisticated high oxygen transmission rate gas permeable membranes.

SUMMARY

Some shortcomings of such packaging systems include the inability to establish ideal oxygen and carbon dioxide atmosphere levels inside the packaging simultaneously. Typically, since the permeation rate for such packages for oxygen and carbon dioxide is same, if the oxygen atmosphere inside the package is 5% the carbon dioxide atmosphere will be 21−5=16%. So in essence the sum of oxygen and carbon dioxide levels will be 21%. Therefore, atmospheres such as 2% Oxygen and 5% Carbon Dioxide cannot be achieved.

Further, many of the packaging systems in use control and/or inhibit the growth of ethylene levels inside the package containing produce. Ethylene is a ripening agent, which is produced naturally in fresh fruits and vegetables as they respire. However, controlling the ethylene levels does not guarantee shelf life or, in the case of flowers, vase life extension, because the oxygen levels and carbon dioxide levels need to be controlled simultaneously. Reduced oxygen levels caused increased metabolic activity and hence reduction in shelf life, and increased carbon dioxide levels leads to tissue softening, and fungal and bacterial growth.

Still further, use of polyethylene bags do not have the adequate permeability needed for long term storage of produce and/or flowers. Issues such as development of anaerobic conditions when the oxygen levels go below 1% and development of high carbon dioxide levels permanently injure the produce; make the use of low density plastic bags incapable in shelf life extensions.

Accordingly, there remains room for improvement in many areas of shelf life and vase life extension technologies.

An objective of the invention is, therefore, to provide a packaging system with a high permeable polymer coated non-woven fabric based packaging, which in essence by naturally establishing modified atmospheres inside a package containing fresh produce/flower can effectively extends its shelf/vase life.

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor. As the produce consumes oxygen and gives off carbon dioxide, an equilibrium gas concentration is established in the package. The gas permeable non-woven film (gas permeable film) is capable of providing different package permeabilities in order to maintain specific oxygen and carbon dioxide levels in a package and maintain this optimum atmosphere even as the temperature is changing. As the produce or other agricultural item consumes oxygen and give off carbon dioxide, the equilibrium gas concentration is established in the package. This process is a function of the permeability of the polymer and its selectivity ratio of oxygen to carbon dioxide. Thus, the created atmosphere is adapted to extend shelf life, maintain high quality and preserve nutrients of fresh produce items by naturally regulating respiration of the agricultural items.

Thus the created atmosphere is able to extend shelf life, maintain high quality and preserve nutrients of fresh produce items by regulating the respiration of the targeted items. Gas Permeable Non-Woven Fabric based Film, which allows for Carbon Dioxide gas to move in and out of the packaging at a rate many times greater than that of Oxygen. By reducing the atmospheric levels of Oxygen and increasing the atmospheric levels of Carbon Dioxide within the packaging, the ripening of fresh produce and fresh cut flowers can be delayed, the produce's respiration and ethylene production rates can be reduced, the softening of the produce can be retarded, and various compositional changes associated with produce ripening can be slowed down.

A particular configuration of the highly permeable non woven fabric based film is obtained by coating nonwoven fabric such as one with 50% polyester and 50% rayon, with a thin layer of polymer, the fabric based system gets its structural strength from the fabric and the permeability from the polymer. This approach enables to reduction in the thickness of the polymer coating on the fabric, and yet maintains enough strength with the fabric, and therefore enhancing its Oxygen Permeation Rate to 110,000 cc/100 in2/day/atm, or even up to 611,111 cc/100 in2/day/atm, with carbon dioxide permeability of at least 350,000 cc/100 in2/day/atm, with a maximum permeability of 3,888,889 cc/100 in2/day/atm at 13° C.

With the above and other objects in view, as will hereinafter appear, a feature of the present invention is the provision of a packaging system including a polyethylene bag, with a hole cutout at the center of the bag, thereof adapted to receive a permeable film, including an adhesive patch for binding the film to the cutout part of the plastic bag, an elastic band for closing the mouth of the plastic bag.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
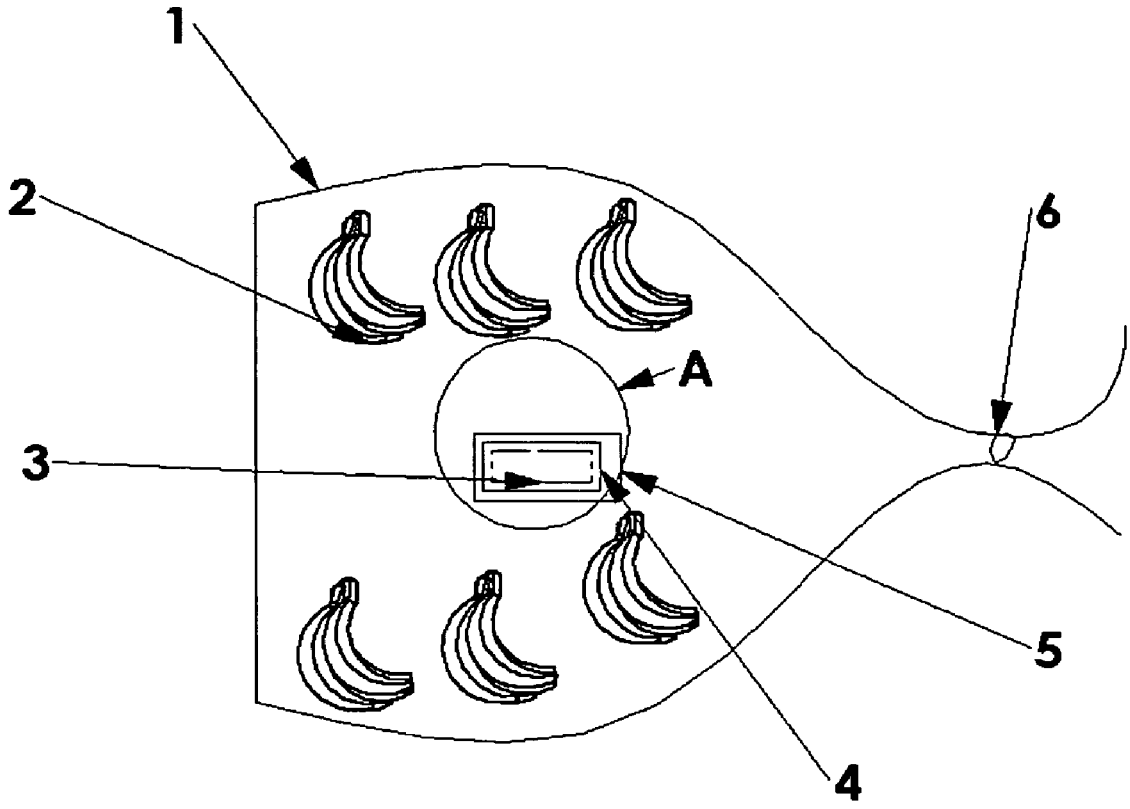
FIG. 1 is a simplified illustration of one form of packaging system with the Gas Permeable Non-Woven Fabric based Film illustrative of an embodiment of the invention.

Depicted below and in accordance with the drawings are example of produce storage and more particularly to such a packaging system as is suitable for extending the shelf life of fresh fruits and vegetables (both whole and fresh cut), and vase life of flowers. The configurations below include formation of the gas permeable non-woven fabric film, or membrane, for providing particular permeability according to a predetermined transfer rate and packaging configurations employing the gas permeable non-woven fabric for storing and transporting produce products stored therein.

The gas permeable non-woven fabric based film (film) is employed in packaging for extending the shelf life of various fresh fruits and vegetables and vase life of fresh cut flowers by changing the atmosphere in which these living products are stored and respires. The high oxygen and carbon dioxide permeability of the film establishes an ideal atmosphere for the specific perishable item, and therefore extends its shelf life. The establishment of lower oxygen and carbon dioxide atmospheres inside packages using the film also leads to reduction in the respiration rate of the perishable items. The reduction in the respiration rate prevents loss of moisture, production of metabolic heat, and yellowing, browning, reduction in production levels of ethylene.

Therefore, the created atmosphere is able to extend shelf life, maintain high quality and preserve nutrients of fresh produce items by naturally regulating respiration of said produce/flower.

Formation of the Gas Permeable Non-Woven Fabric based Film fabrication process includes creation of these films. The components for the film include polydimethyl siloxane (PDMS) base (This polydimethyl siloxane either consists of >60.0% Dimethyl siloxane, dimethylvinyl-terminated, 30.0-60.0% Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica), and curing agent mixed in the ratio 10:1, non-woven fabric (50% polyester, 50% Rayon). A mayer Rod (#3, which creates a film thickness of 0.27 MIL) was also used.

b. Mix the PDMS base and curing agent in a 10:1 ratio measured by weight c. De-gas the polymer in a desiccator for approximately 30 minutes. This removes any air bubbles resulting from the mixing process.

d. Pour this mixture on a non woven fabric, and roll the Mayer Rod #3 to form a uniform spread. Mayer rod #3 deposits a thickness of 0.27 MIL on the fabric.

e. Preheat oven for 20 minutes at 170° F. (76.6° C.).

f. Cure the PDMS-coated fabric at 170° F. (76.6° C.) for 20 minutes to promote cross-linking.

Process to design packages using the Gas Permeable Non-Woven Fabric based film. The respiration rates, ideal atmospheres, and ethylene sensitivities for various perishable items, including fresh fruits and vegetables and fresh cut flowers have been documented by University of California, Davis. The information available was utilized in designing these packages.

a. Identify the perishable item that is to have a shelf life extension. Items identified and tested have included, broccoli, cilantro, bananas, whole corn, lettuce, tomatoes, red seedless grapes, mushrooms, strawberries and cut flowers (roses, orchids, gerbera and tulips).

b. For example, in the case of bananas, the respiration rates, ideal atmospheres and ideal storage temperatures were identified. The Oxygen transmission Rates (OTR) and Carbon Dioxide transmission Rates (COTR) for the Gas Permeable Non-Woven Fabric based film have already been tested by an independent test agency, Mocon Inc., of Minneapolis, Minn. The OTR and COTR values define the permeability for particular agricultural items, for example by measuring the weight of the produce, such as bananas. In a particular configuration, the OTR and COTR for these films at 13.3° C. (an ideal temperature for bananas) tested at 111,735 and 699,000 cc/100 in^2/day/atm respectively. Using the weights, respiration rates, ideal atmospheres, COTR and OTR of these films, the surface area needed for these films can be calculated. Take the produce bag, can be low density polyethylene bag (LDPE), high density polyethylene bag (HDPE), or any other non-porous material based, used to store bananas, and cut a hole in the bag equivalent to the surface area needed for the film.

c. Using a good adhesive tape (such as electrical insulating tape), attach the Gas Permeable Non-Woven Fabric based film at the position where the produce bag has a hole.

d. Place the produce, such as banana inside the bag.

e. Using a regular elastic band close the opening of the produce bag.

The produce bag with the Gas Permeable Non-Woven Fabric based Films will naturally attain the ideal atmospheres needed for bananas, and therefore will extend its shelf life. Testing results have successfully been able to extend the life of bananas to 20+ days.

As the produce or other agricultural items respire, they consume oxygen and give off carbon dioxide, and an the equilibrium gas concentration is established in the package. This process is a function of the gas permeable film permeability and carbon dioxide to oxygen selectivity ratio. Thus, the created atmosphere (typically 2-20% oxygen and 5-15% carbon dioxide) is able to extend shelf life, maintain high quality and preserve the nutrients by naturally regulating respiration of the produce and/or agricultural items. Lower oxygen levels substantially around 2% reduce the metabolic activity of the perishable item (produce) and elevated carbon dioxide levels prevent rotting and fungal growth. Lower levels of oxygen also reduce the ethylene production of the perishable items. Predominantly perishable items with high sensitivity towards ethylene benefit from avoidance of elevated ethylene levels. Ethylene promotes ripening of bananas, and therefore lower ethylene levels tend to extend the shelf life of bananas. By changing the surface area and the thickness of the gas permeable film, the permeabilities to oxygen and carbon dioxide can be controlled, and therefore longer shelf life agricultural items such as fruits and vegetables is promoted.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

Referring to FIG. 1, it will be seen that an illustrative configuration includes a non-perforated polyethylene bag 1 with perishable item 2, with a hole cutout 3 at the center of the bag, thereof adapted to receive a permeable film 4, including an adhesive patch 5 for binding the permeable film to the cutout part of the plastic bag and an elastic band 6 for closing the mouth of the plastic bag.

Figure 2:
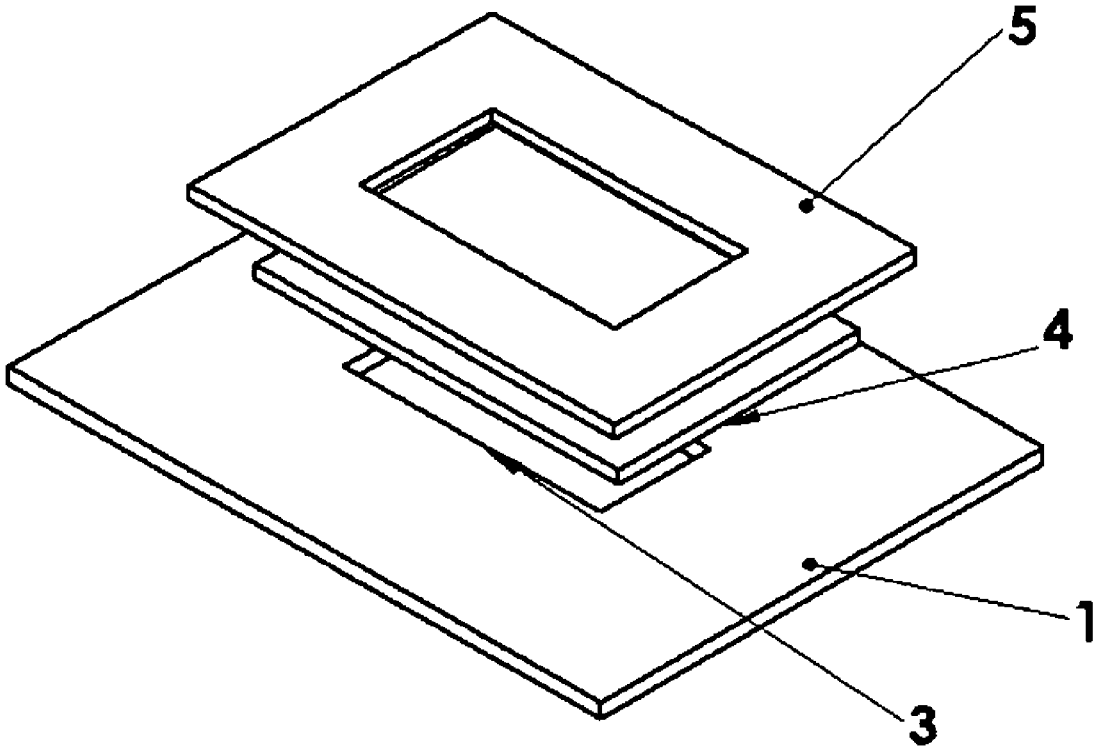
FIG. 2 is a an illustration an enlarged view of matter in circle A of FIG. 1.
Figure 3:
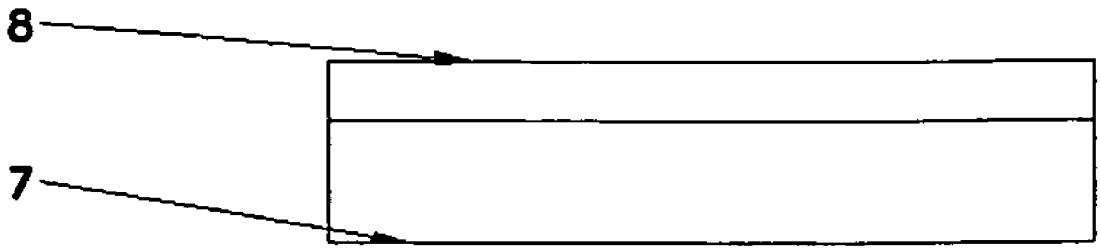
FIG. 3 is an illustration of the Gas Permeable Non-Woven Fabric based film.

FIG. 2 is an enlarged view of matter in circle A of FIG. 1;

Referring to FIG. 3, it will be seen that an illustrative example includes a non-woven fabric 7 (50% polyester, 50% Rayon) with a coating of polymer 8 consisting of polydimethyl siloxane either consists of >60.0% Dimethyl siloxane, dimethylvinyl-terminated, 30.0-60.0% Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica, and curing agent mixed in the ratio 10:1.

Depicted below are examples of the gas permeable non-woven fabric employed for storage and transportation of produce and vegetative specimens in accordance with the teachings herein. Additional information concerning post harvest conditions for various produce items may be obtained from the website for the University of California, Davis Department of Plant Sciences and other sources as known in the art.

Example 1

Using post harvest information available for bananas from the University of California, Davis Department of Plant Sciences, ideal atmospheres for bananas was 2-5% Oxygen, 2-5% Carbon Dioxide, at storage temperature of 13° C. (56° F.), with respiration rate of 38.7 ml CO2/kg·hr. With 30 pounds of green bananas inside a package with the Gas Permeable Non-Woven Fabric based film, with thickness of 0.27 MIL, patch size for the film was established as a square of length 4.15 inches and width 4.15 inches. The oxygen and carbon dioxide permeability for such a package is 407,407 and 2,592, 593 cc/100 in2/day/atm at 55° F. (13° C.). Using the Gas Permeable Non-Woven Fabric based packaging shelf life of bananas was increased at a minimum 14 days. When compared with bananas without this packaging, the bananas turned black and mushy and were inedible just after 10 days.

Example 2

Using post harvest information available for mangos at University of California, Davis Department of Plant Sciences, ideal atmospheres for mangos was 3-5% Oxygen, 5-8% Carbon Dioxide, at storage temperature of 10° C. (50° F.), with respiration rate of 22 ml CO2/kg·hr. With 8.8 pounds (4 kilograms) of mango inside a package with the Gas Permeable Non-Woven Fabric based film, with thickness of 0.27 MIL, patch size for the film was established as a square of length 3.43 inches and width 3.43 inches. The oxygen and carbon dioxide permeability for such a package is 407,407 and 2,592, 593 cc/100 in2/day/atm at 55° F. (13° C.). Using the Gas Permeable Non-Woven Fabric based packaging shelf life of mangos was increased at a minimum by 20 days. When compared with mangos without this packaging, the mangos turned black and softened and were not inedible just after 12 days. These mangos had a distasteful odor to them as well.

Example 3

Using post harvest information available for whole corn from the University of California, Davis, ideal atmospheres for whole corn was 3-5% Oxygen, 10% Carbon Dioxide, at storage temperature of 1.1° C. (34° F.), with respiration rate of 51 ml CO2/kg·hr. With 2.86 pounds (1.3 kilograms) of corn inside a package with the Gas Permeable Non-Woven Fabric based film, with thickness of 0.27 MIL, patch size for the film was established as a square of length 1.47 inches and width 1.47 inches. The oxygen and carbon dioxide permeability for such a package is 407,407 and 2,592, 593 cc/100 in2/day/atm at 55° F. (13° C.). Using the Gas Permeable Non-Woven Fabric based packaging shelf life of whole corn was increased at a minimum 24 days. When compared with corn without this packaging, the corn became dry and inedible after 11 days.

Example 4

Using post harvest information available for tomato from the University of California, Davis, ideal atmospheres for tomato was 3-5% Oxygen, 3% Carbon Dioxide, at storage temperature of 13.6° C. (56° F.), with respiration rate of 15 ml CO2/kg·hr. With 9.9 pounds (4.5 kilograms) of tomato inside a package with the Gas Permeable Non-Woven Fabric based film, with thickness of 0.27 MIL, patch size for the film was established as a square of length 1.48 inches and width 1.48 inches. Using the Gas Permeable Non-Woven Fabric based packaging shelf life of tomato was increased up to 21 days. When compared with tomato without this packaging, the tomato developed fungal growth by Day 11.

Example 5

Ideal atmospheres for fresh cut roses is 5% Oxygen, 5% Carbon Dioxide, with respiration rate of 19.6 ml CO2/kg·hr. With 33 pounds (15 kg) roses, packaged inside a package with Gas Permeable Non-Woven Fabric based film, with thickness of 0.27 MIL, patch size of for the film was established as 3.57 inches by 3.57 inches. Using the Gas Permeable Non-Woven Fabric based packaging shelf life of cut roses was increased up to 14 days. When compared with roses without this packaging, the roses developed Botrytis, by Day 4.

What is claimed is:

1. A Gas Permeable Film, consisting of a. a non-woven fabric substrate, the substrate adapted for transmission of gases;

b. a polymer coating on the non-woven fabric substrate, the polymer coating having a thickness between 0.18 MIL-2.0 MIL, the thickness dependent upon a type of a produce item, the produce item responsive to a created atmosphere resulting from the polymer coating, and the weight of the produce items;

i. the polymer coating having an oxygen permeability of at least 55,000 cc/100 in2/day/atm, with a maximum permeability of 611,111 cc/mil/100 in2/day/atm at 13° C.; and ii. the polymer coating having a carbon dioxide permeability of at least 350,000 cc/100 in2/day/atm, with a maximum permeability of 3,888,889 cc/100 in2/day/atm at 13° C.

2. The gas permeable film of claim 1 wherein the substrate is a non-woven fabric with high permeability towards oxygen and carbon dioxide, the non-woven fabric comprised of at least one of:

at least 50% polyester; or at least 50% rayon.

3. The gas permeable film of claim 1 wherein the polymer coating is derived from a curing agent mixture degassed in a desiccator for removing air bubbles resulting from the mixing process.

4. The gas permeable film of claim 3 wherein the base is polydimethyl siloxane selected from the group consisting of:

>60.0% Dimethyl siloxane, dimethylvinyl-terminated, 30.0-60.0% Dimethylvinylated and trimethylated silica, and 1.0-5.0% Tetra(trimethylsiloxy) silane; or >60.0% Dimethyl siloxane, dimethylvinyl-terminated and 30.0-60.0% Dimethylvinylated and trimethylated silica.

5. The gas permeable film of claim 3 wherein the substrate is non-woven fabric comprising at least one of polyester or rayon.

6. The gas permeable film of claim 5 wherein the substrate is a non-gauze nonwoven fabric.

7. The gas permeable film of claim 3 wherein the polymer is poly(dimethylsiloxane) PDMS.

8. The gas permeable film of claim 1 wherein the predetermined thickness is generated from a layering rod rolled across the substrate and corresponds to values for oxygen permeability and carbon dioxide permeability adapted to generate a created atmosphere based on the produce item.

9. The produce package of claim 1 wherein binding the gas permeable film further comprises forming the gas permeable film by:

providing a polymer base having selective permeability of oxygen and carbon dioxide when cured at a predetermined thickness;

mixing a curing agent with the polymer base to generate a mixed polymer base;

desiccating the mixed polymer base for removing air bubbles formed during the mixing;

depositing the mixed polymer base on a substrate, the substrate having a predetermined permeability when layered with the mixed polymer base;

rolling a layering rod over the substrate to form a uniform spread having a predetermined thickness determined by the layering rod; and curing the rolled substrate to cause cross-linking of the polymer base resulting in a gas permeable film having the predetermined selective permeability.

10. The method of claim 9 further comprising:

identifying a target permeability of oxygen identifying a target permeability of carbon dioxide determining the predetermined thickness based on the identified target permeability.

11. The method of claim 10 further comprising:

identifying a quantity of agricultural items for storage;

determining a package volume based on the identified quantity; and computing, based on the determined package volume and the identified target permeability, an area of the gas permeable film corresponding to the package.

12. The method of claim 11 wherein the layering rod is a Mayer rod having a diameter corresponding to the deposited thickness of the mixed polymer base on the substrate.

13. The method of claim 12 wherein layering rod is a #3 Mayer rod and the thickness is substantially 0.18 MILs.

14. The method of claim 12 wherein the mixing agent is a non-reactive curing agent, further comprising mixing the curing agent in a 10:1 ratio with the polymer base.

15. The method of claim 12 wherein desiccating further comprises degassing the polymer in a desiccator for between 25-35 minutes.

16. The package of claim 15 wherein the predetermined area is further based on an identified quantity of agricultural items for storage;

a determined a package volume based on the identified quantity; and a computed area, the computed area based on the determined package volume and the target permeability, an the predetermined area defining an area of the gas permeable film corresponding to the package.

17. The Gas Permeable Film of claim 1 wherein the CO2 permeability is between 1182-13,138 Barrer and the O2 permeability is between 186-2064 Barrer.

18. A produce package including a Gas Permeable film, the package defining a created atmosphere therewithin for extending a shelf life of agricultural items; the package further comprising:

a non-perforated polyethylene bag adapted to receive the agricultural items;

a hole cutout in the bag adapted to receive a Gas Permeable film;

an adhesive patch for binding the Gas Permeable film to the cutout part of the plastic bag; and a mouth adapted to receive an elastic band for closing the mouth of the non-perforated plastic bag, the gas permeable film further comprising:

a polymer coating on a non-woven fabric substrate, the polymer coating having a predetermined thickness ranging between 0.18 MIL to 2 MIL dependent upon a type of a produce item, the produce item responsive to a created atmosphere resulting from the polymer coating;

the polymer coating having an oxygen permeability of at least 55,000 cc/100 in2/day/atm, with a maximum permeability of 611,111 cc/mil/100 in2/day/atm at 13° C.; and the polymer coating having a carbon dioxide permeability of at least 350,000 cc/100 in2/day/atm, with a maximum permeability of 3,888,889 cc/100 in2/day/atm at 13° C.

19. The package of claim 18 wherein the hole cutout has a predetermined area, the predetermined area derived from:

a target permeability of oxygen for maintaining the created atmosphere; and a target permeability of carbon dioxide for maintaining the created atmosphere, the predetermined area maintaining the created atmosphere by receiving the gas permeable film having the predetermined area.

* * * * *